US009611746B2

(12) United States Patent
Luczak

(10) Patent No.: US 9,611,746 B2
(45) Date of Patent: Apr. 4, 2017

(54) BLADE WEDGE ATTACHMENT

(75) Inventor: Blake J. Luczak, Pittsburgh, PA (US)

(73) Assignee: United Technologies Corporation, Hartford, CT (US)

( * ) Notice: Subject to any disclaimer, the term of this patent is extended or adjusted under 35 U.S.C. 154(b) by 951 days.

(21) Appl. No.: 13/430,101

(22) Filed: Mar. 26, 2012

(65) Prior Publication Data

US 2013/0247586 A1 Sep. 26, 2013

(51) Int. Cl.

*F01D 5/26* (2006.01)
*F01D 5/28* (2006.01)
*F01D 5/30* (2006.01)

(52) U.S. Cl.

CPC ..... *F01D 5/26* (2013.01); *F01D 5/282* (2013.01); *F01D 5/3007* (2013.01); *F01D 5/3084* (2013.01); *F01D 5/3092* (2013.01)

(58) Field of Classification Search

CPC ..... F01D 5/30; F01D 5/3007
See application file for complete search history.

(56) References Cited

U.S. PATENT DOCUMENTS 3,752,600 A * 8/1973 Walsh et al. ..... 416/219 R
4,040,770 A 8/1977 Carlson
4,169,694 A * 10/1979 Sanday ..... F01D 5/3007 416/219 R
4,343,593 A 8/1982 Harris
5,275,536 A * 1/1994 Stephens et al. ..... 416/248
5,573,377 A 11/1996 Bond et al.
6,132,175 A 10/2000 Cai et al.
6,398,499 B1 * 6/2002 Simonetti et al. ..... 416/193 A
7,329,101 B2 2/2008 Carper
7,968,031 B2 6/2011 Carper
8,105,039 B1 1/2012 El-Aini et al.
8,282,356 B2 * 10/2012 Cairo ..... 416/219 R
2009/0016890 A1 1/2009 Douguet et al.
2011/0299994 A1 * 12/2011 Behnisch et al. ..... 416/230

FOREIGN PATENT DOCUMENTS

WO 0233224 4/2002

OTHER PUBLICATIONS

International Search Report and Written Opinion for International Application No. PCT/US2013/033204 completed on Jun. 25, 2013.
International Preliminary Report on Patentability for PCT Application No. PCT/US2013/033204, mailed Oct. 9, 2014.
Singapore Search Report for Singapore Patent Application No. 11201405358U mailed Jun. 12, 2015.

* cited by examiner

*Primary Examiner* — Eric Keasel
*Assistant Examiner* — Cameron Corday
(74) *Attorney, Agent, or Firm* — Carlson, Gaskey & Olds, P.C.

(57) ABSTRACT

A rotor includes a disk that has slots circumferentially arranged around its periphery. Blades include respective roots that are mounted in respective ones of the slots. The roots are smaller than the slots such that there are circumferential gaps between the roots and circumferential sides of the slots. Wedges are respectively located within the circumferential gaps. The wedges are free floating with regard to the blades and the disk.

24 Claims, 6 Drawing Sheets

BLADE WEDGE ATTACHMENT

BACKGROUND

This disclosure relates to rotors that have blades that are mounted in slots in a rotor disk.

Rotors, such as turbine rotors in gas turbine engines, typically include a disk that has axially-extending slots around its periphery for mounting turbine blades. The slots have a "toothed" profile and each of the blades has a root with a corresponding profile to interlock with the toothed profile of the slots. Typically, the root is joined to an airfoil of the blade through a relatively narrow neck and fillet. A challenge in securing the blades is that during operation, stresses on the blade can be concentrated at the relatively narrow neck and fillet. One technique for mitigating stress is to secure pads near the neck and fillet.

SUMMARY

A rotor according to an exemplary aspect of the present disclosure includes a disk including slots circumferentially arranged around its periphery and blades including slots such that there are circumferential gaps between the roots and circumferential sides of the slots, and wedges are respectively located in the circumferential gaps. The wedges are free floating with regard to the blades and the disk.

In a further non-limiting embodiment of any of the foregoing examples, each of the wedges includes less than three flat sides.

In a further non-limiting embodiment of any of the foregoing examples, each of the blades includes a ceramic material.

In a further non-limiting embodiment of any of the foregoing examples, the ceramic material is a multi-layer fiber structure including a ceramic matrix.

In a further non-limiting embodiment of any of the foregoing examples, each of the wedges includes at least one crowned side.

In a further non-limiting embodiment of any of the foregoing examples, each of the wedges includes a plurality of crowned sides.

In a further non-limiting embodiment of any of the foregoing examples, each of the wedges includes sides that are in contact with either the blades or the circumferential sides of the slots, each of the sides being either a flat side or a crowned side such that there is a number $N_1$ of flat sides and a number $N_2$ of crowned sides, and a ratio of $N_1/N_2$ is 2 or less.

In a further non-limiting embodiment of any of the foregoing examples, $N_1$ is 2 and $N_2$ is 1.

In a further non-limiting embodiment of any of the foregoing examples, $N_1$ is 0 and $N_2$ is 2.

In a further non-limiting embodiment of any of the foregoing examples, $N_1$ is 2 and $N_2$ is 3.

In a further non-limiting embodiment of any of the foregoing examples, $N_1$ is 1 and $N_2$ is 2.

In a further non-limiting embodiment of any of the foregoing examples, $N_1$ is 1 and $N_2$ is 1.

A rotor according to an exemplary aspect of the present disclosure further includes a width dimension (Q) of a neck of the respective blades, a length dimension (L) of a side of the respective wedges in contact with the circumferential side of the disk, a length dimension (E) of a straight portion of another side of the respective wedges, a length dimension (H) of a straight portion of another, different side of the respective wedges, an overlap dimension (X) between the circumferential side of the disk and the side of the respective wedges that has length dimension (L), a gap dimension (B) between a flared root of the respective blades and the side of the respective wedges that has length dimension (E) at a point of transition between a straight portion and a curved portion, and a gap dimension (W) between the neck and the side of the respective wedges that has length dimension (H) at a point of transition between a straight portion and a curved portion, and including at least one of:

W/Q is less than or equal to 0.025,

W/H is less than or equal to 0.1,

X/L is less than or equal to 0.050, and

B/E is less than or equal to 0.080.

In a further non-limiting embodiment of any of the foregoing examples, each of the wedges includes a coating thereon that surrounds a core.

In a further non-limiting embodiment of any of the foregoing examples, bias members are located in respective ones of the slots radially inwardly of the blades, the bias members biasing the blades radially outwardly.

A gas turbine engine according to an exemplary aspect of the present disclosure includes optionally, a fan, a compressor section, a combustor in fluid communication with the compressor section, and a turbine section in fluid communication with the combustor, the turbine section being coupled to drive the compressor section and the fan. At least one of the fan, the turbine section and the compressor section includes a disk having slots circumferentially arranged around its periphery and blades including respective roots that are mounted in respective ones of the slots. The roots are smaller than the slots such that there are circumferential gaps between the roots and circumferential sides of the slots, and wedges are respectively located within the circumferential gaps. The wedges are free floating with regard to the blades and the disk.

A rotor according to an exemplary aspect of the present disclosure includes a disk which includes slots circumferentially arranged around its periphery and blades that are mounted in respective ones of the slots. Each of the blades includes an airfoil, a neck that extends radially inwardly from the airfoil, a flared root and, relative to the flared root, a narrow fillet joining the neck and the flared root. Each of the blades includes a coating over at least a portion of the neck, the narrow fillet and at least a portion of the flared root. The coating includes a relatively thick section on each circumferential side of the narrow fillet. The relatively thick portion is operable as a wedge to compress the narrow fillet upon rotation of the disk.

In a further non-limiting embodiment of any of the foregoing examples, the coating includes a silicon-containing material.

In a further non-limiting embodiment of any of the foregoing examples, the coating is silicon metal.

In a further non-limiting embodiment of any of the foregoing examples, the coating is silicon carbide.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION OF THE PREFERRED EMBODIMENT

Figure 1:
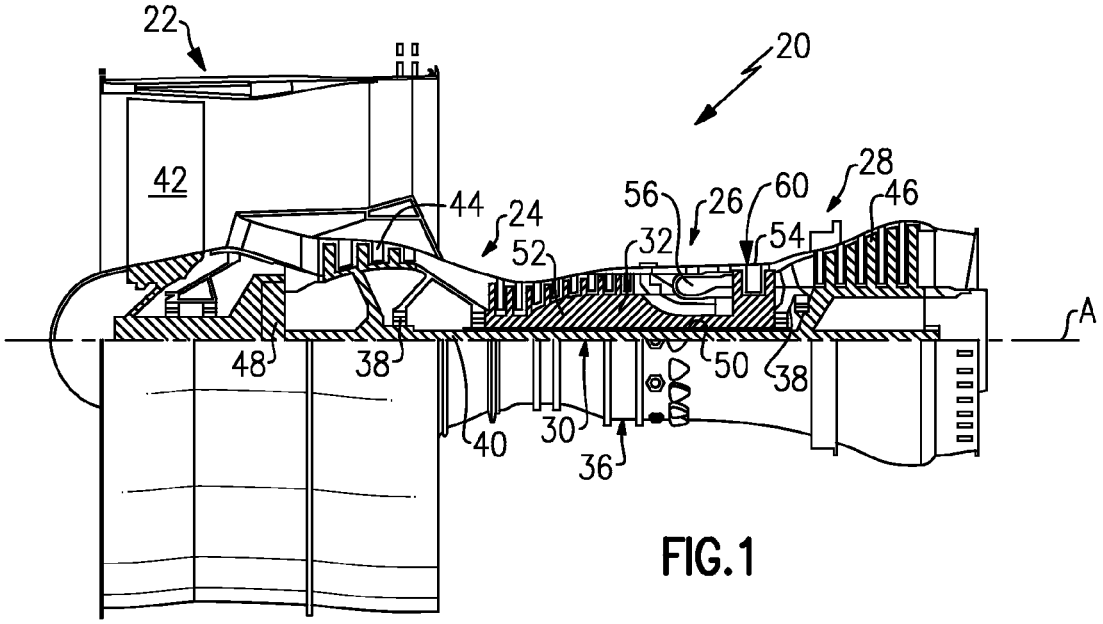
FIG. 1 shows an example gas turbine engine.

FIG. 1 schematically illustrates a gas turbine engine 20. The engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures and land-based turbines.

The engine 20 in this example includes a first spool 30 and a second spool 32 mounted for rotation about an engine central axis A relative to an engine static structure 36 via several bearing systems 38. It should be understood that various bearing systems 38 at various locations may alternatively or additionally be provided.

The first spool 30 generally includes a first shaft 40 that interconnects a fan 42, a first compressor 44 and a first turbine 46. The first shaft 40 is connected to the fan 42 through a gear assembly of a fan drive gear system 48 to drive the fan 42 at a lower speed than the first spool 30. The second spool 32 includes a second shaft 50 that interconnects a second compressor 52 and second turbine 54. The first spool 30 runs at a relatively lower pressure than the second spool 32. It is to be understood that "low pressure" and "high pressure" or variations thereof as used herein are relative terms indicating that the high pressure is greater than the low pressure. An annular combustor 56 is arranged between the second compressor 52 and the second turbine 54. The first shaft 40 and the second shaft 50 are concentric and rotate via the bearing systems 38 about the engine central axis A which is collinear with their longitudinal axes.

The core airflow is compressed by the first compressor 44 then the second compressor 52, mixed and burned with fuel in the annular combustor 56, then expanded over the second turbine 54 and first turbine 46. The first turbine 46 and the second turbine 54 rotationally drive, respectively, the first spool 30 and the second spool 32 in response to the expansion.

Figure 2:
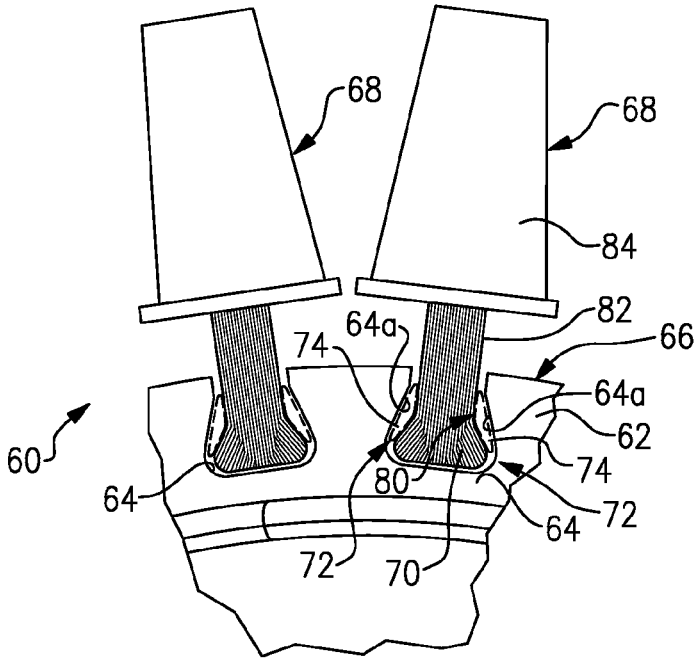
FIG. 2 shows an example rotor.

In the illustrated example, at least the second turbine 54 includes a turbine rotor 60 that is disposed about the engine central axis A. FIG. 2 illustrates a portion of the turbine rotor 60, although it is to be understood that the examples disclosed herein are also applicable to rotors of the first turbine 46 and rotors of the compressor section 24, as well as rotors of non-engine machines.

The rotor 60 includes a disk 62 that has slots 64 circumferentially arranged about its periphery 66. For example, the slots 64 generally extend axially, but are not necessarily parallel to the engine central axis A. That is, the slots 64 may extend in a direction parallel to the engine central axis A, in a direction that is inclined relative to the engine central axis A. Further the slots 64 may be straight or curved slots. The illustrated slots are straight.

Blades 68 are mounted in respective ones of the axial slots 64. For example, the blades 68 are or include a ceramic matrix fiber composite, organic matrix fiber composite, metal alloy or monolithic ceramic material. As shown, the blades 68 are the ceramic matrix fiber composite and include a multi-layer fiber structure 90 including a ceramic matrix 90*a*.

Each of the blades 68 includes a flared root 70 that is received in the respective axial slot 64. In general, the flared roots 70 are smaller than the axial slots 64 such that there are circumferential gaps 72 between the flared roots 70 and circumferential sides 64*a* of the axial slots 64. Wedges 74 are respectively located within the circumferential gaps 72. The wedges 74 are free floating with regard to the blades 68 and the disk 62.

A relatively narrow section of the blade 68 is known as a narrow fillet 80, which joins a neck 82 and the flared root 70. The neck 82 extends radially inwardly from an airfoil 84. In general, upon loading of the blade 68, the geometry of the flared root 70 and the axial slot 64 concentrates stress at the narrow fillet 80. Without being bound to a particular theory, in particular for multi-layer fiber structures, such as the multi-layer fiber structure 90 including the ceramic matrix 90*a*, the stress manifests as a bending stress at the narrow fillet 80 that produces a tensile stress (mechanical disadvantage) across layer interfaces. The tensile stress thus tends to cause layer delamination. However, even for blades 68 that are not made of a multi-layer fiber structure, the narrow fillet 80 is a location of stress concentration and thus would benefit from stress mitigation. As will be described, the wedges 74 function to compress the narrow fillet 80 and thus mitigate the tensile stress at the location of the narrow fillet 80. For multi-layer fiber structures, the wedges 74 limit or eliminate layer delamination in the blades 68.

Figure 3A:
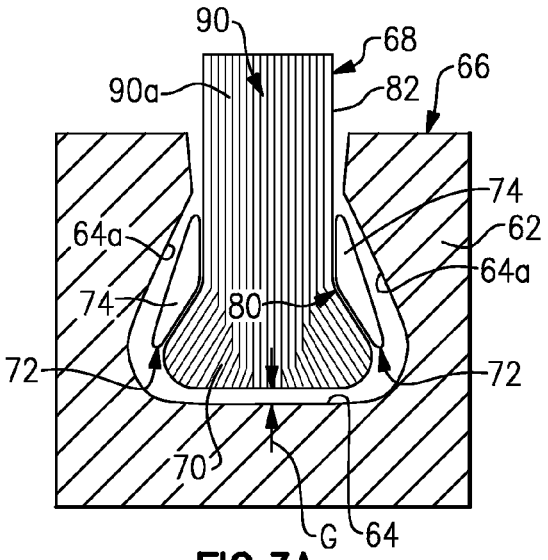
FIG. 3A shows a blade in a slot of a rotor and floating wedges, in an unloaded condition.
Figure 3B:
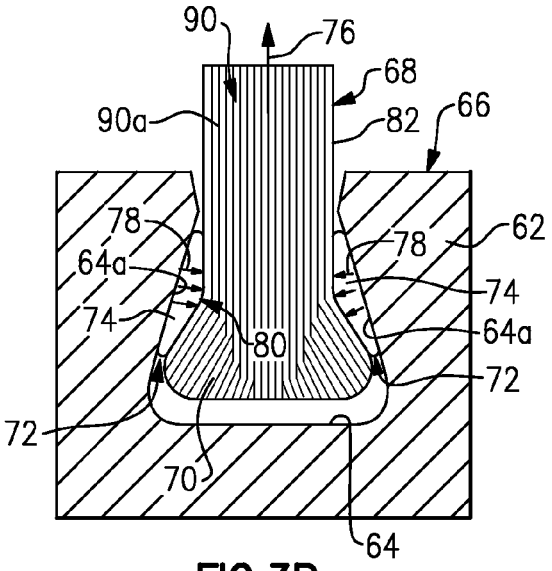
FIG. 3B shows the blade of FIG. 3A in a loaded condition.

FIG. 3A illustrates an isolated view of one of the axial slots 64 and blades 68 in an unloaded condition with the wedges 74 floating freely in the circumferential gaps 72. FIG. 3B shows the blade 68 in a loaded condition, as indicated by arrow 76. In the unloaded condition, the wedges 74 float freely with regard to the blade 68 and disk 62 and are thus able to move within the circumferential gaps 72. In this regard, the blades 68 and the disk 62 can be designed with a minimal gap G between the bottom of the blade 68 and the axial slot 64 to restrict blade 68 movement and thus limit movement of the wedges 74. Cover plates (not shown) on axial sides of the disk 62 may retain the wedges 74 axially.

In the loaded condition when the rotor 60 is rotating, the blade 68 moves radially outwardly relative to the engine central axis A such that the wedges 74 are captured between the blade 68 and the circumferential sides 64*a* of the slot 64. In this regard, the blades 68 and disk 62 may be designed with relatively tight tolerances and with relatively smooth surface finishes to reduce friction and control location of the wedges 74. In one example, the surface finishes are 63 microinches/1.6 micrometer or less.

In the loaded condition, the wedges 74 exert a compressive pressure, as indicated by arrows 78, at the narrow fillet 80 of the blade 68 to thereby mitigate tensile stresses in this location. The principles of force summation that result in the pressure are generally known and are thus not further discussed. Additionally, since the wedges 74 are free-floating within the circumferential gaps 72, the wedges 74 can self-adjust, or normalize, as the load is applied to the blade 68 to provide a proper positioning for compressing the narrow fillet 80. In comparison, secured wedges or pads are unable to self-adjust and may not be properly positioned to compress a narrow fillet with the effectiveness of the free-floating wedges 74.

Figure 3C:
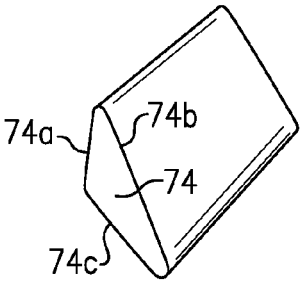
FIG. 3C shows an isolated view of a wedge.

As shown in FIG. 3C, the wedges 74 generally have a tapered profile. In this example, each of the wedges 74 includes a first side 74*a*, a second side 74*b* and a third side 74*c*. The sides 74*a-c* are the sides of the wedge 74 that are in contact with either the blade 68 or circumferential side 64*a* of the slot 64. In this example, side 74*a* is in contact with the neck 82 of the blade. Side 74*b* is in contact with the circumferential side 64*a*, and side 74*c* is in contact with the flared root 70.

Each of the sides 74*a-c* can be either a flat side or a crowned side such that there is a number $N_1$ of flat sides and a number $N_2$ of crowned sides. In this example, each of the sides 74*a-c* are flat. Similarly, at least in the areas that are in contact with the sides 74*a-c* of the wedge 74, the neck 82, the circumferential side 64*a* and flared root 70 are also flat such that the interfaces between the sides 74*a-c* and, respectively, the neck 82, the circumferential side 64*a* and flared root 70 can be described as flat/flat ("flat on flat") interfaces. The shape of the sides (flat or crowned) 74*a-c* and the type of interface with the neck 82, the circumferential side 64*a* and flared root 70 control how the wedge 74 distributes compressive pressure to the narrow fillet 80.

In general, the following additional examples show modified wedges and flared roots, where the modified wedges have flat or crowned sides and the neck, the circumferential side and flared root are flat or crowned to provide flat/flat, crowned/crowned or crowned/flat interfaces that facilitate positioning of the wedges and distribution of compressive pressure on a narrow fillet. For example, a flat/flat interface or matching curve/curve interface provides a relatively even distribution or pressure at the interface, while a flat/curved interface provides a point or line contact with a relatively focused pressure at the point or line of contact. In the drawings, a point or line contact is indicated by a cross-tick mark (e.g., see FIG. 5) and an area interface (flat/flat interface or matching curve/curve interface) is indicated by a bracket "[" mark adjacent the interface. Further, line contacts may be used where tolerances can cause relative misalignment between flat sides and thus eliminate or reduce variations in pressure distribution from misalignment. The types of interfaces can thus be tailored to control the pressure distribution at or around a narrow fillet. In these following examples, the sides of the modified wedges have a ratio of $N_1/N_2$ ($N_1$ divided by $N_2$) that is 2 or less for producing a distributed compressive pressure on the narrow fillet.

Figure 4:
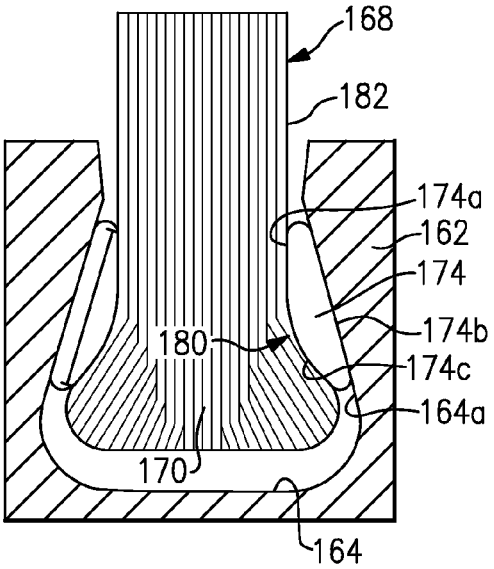
FIGS. 4-9 each show another example rotor.

FIG. 4 illustrates a modified wedge 174. In this disclosure, like reference numerals designate like elements where appropriate and reference numerals with the addition of one-hundred or multiples thereof designate modified elements that are understood to incorporate the same features and benefits of the corresponding elements. In this example, each of the wedges 174 includes a flat, first side 174*a*, a flat, second side 174*b* and a crowned, third side 174*c*. Thus, $N_1$ is 2 and $N_2$ is 1. The first side 174*a* is in contact with the neck 182 in a flat/flat interface. The second side 174*b* is in contact with the circumferential side 164*a* in a flat/flat interface, and the third side 174*c* is in contact with the flared root 170. The portion of the flared root 170 and narrow fillet 180 that is in contact with the third side 174*c* is contoured to match the curvature of the third side 174*c*. Thus, the third side 174*c* and the flared root 170 have a curved/curved interface. The narrow fillet 180 in this example has relatively gradual curvature in comparison to the narrow fillet 80 of the previous example, which facilitates a reduction in bending stress.

Figure 5:
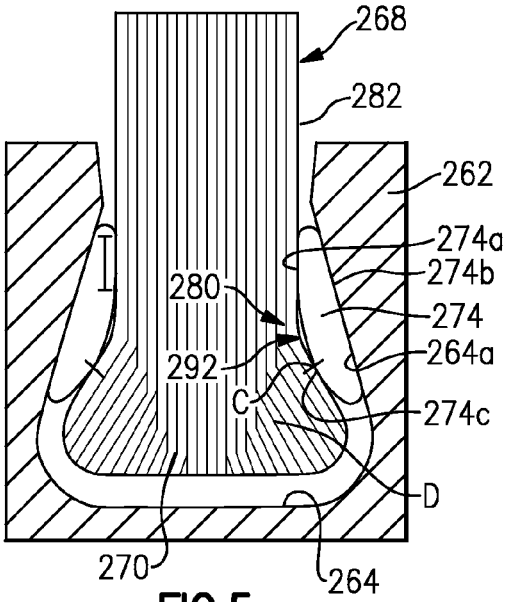

Referring to another modified wedge 274 shown in FIG. 5, the wedge 274 includes a flat, first side 274*a*, a flat, second side 274*b* and a crowned, third side 274*c*. Thus, $N_1$ is 2 and $N_2$ is 1. In this example, the portion of the flared root 270 that is in contact with the third side 274*c* is not contoured to match the curvature of the crowned, third side 274*c*. Thus, there is a line contact C between the crowned, third side 274*c* and the flared root 270 that enhances alignment. The line contact C produces a gap 292 at the narrow fillet 280. Additionally, the line contact C can be designed at a location that corresponds to a feature in the blade 268, such as a location of layer drops D that extend laterally to form the flared root 270. By focusing at least a portion of the compressive pressure at the layer drops D, the layer drops D transfer the pressure to the region of the narrow fillet 280.

Figure 6:
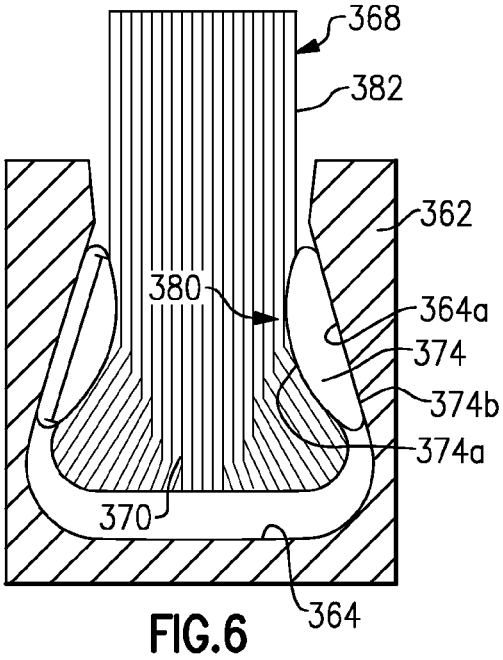

FIG. 6 illustrates another modified wedge 374 that has a crowned, first side 374*a* and a flat, second side 374*b*. Thus, $N_1$ is 1 and $N_2$ is 1. The crowned, first side 374*a* is in contact with the flared root 370 in a curved/curved interface and the flat, second side 374*b* is in contact with the circumferential side 364*a* of the axial slot 364 in a flat/flat interface. The relatively gradual curvature of the narrow fillet 380 facilitates the reduction in bending stress and varies pressure direction along the narrow fillet 380.

Figure 7:
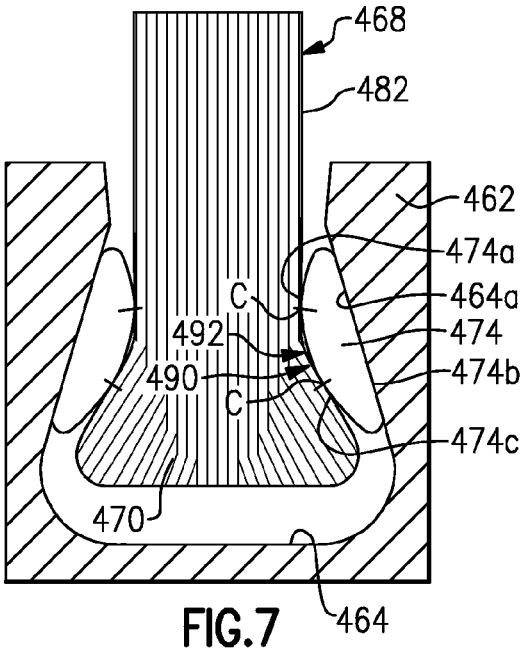

FIG. 7 shows another modified wedge 474 that has a crowned, first side 474*a*, a flat, second side 474*b* and a crowned, third side 474*c*. Thus, $N_1$ is 1 and $N_2$ is 2. The crowned, first side 474*a* is in contact with the neck 482 of the blade 468 in a flat/curved interface. The flat, second side 474*b* is in contact with the flat, circumferential side 464*a* of the axial slot 464 in a flat/flat interface. The crowned, third side 474*c* is in contact with the flared root 470 in a flat/curved interface. The portion of the neck 482 that contacts the first side 474*a* and the portion of the flared root 470 that contacts the third side 474*c* are not contoured to match the curvatures of, respectively, the first side 474*a* and the third side 474*c* such that there are two lines of contact C. The two lines of contact C enhance alignment and pressure distribution at the narrow fillet 490.

Figure 8:
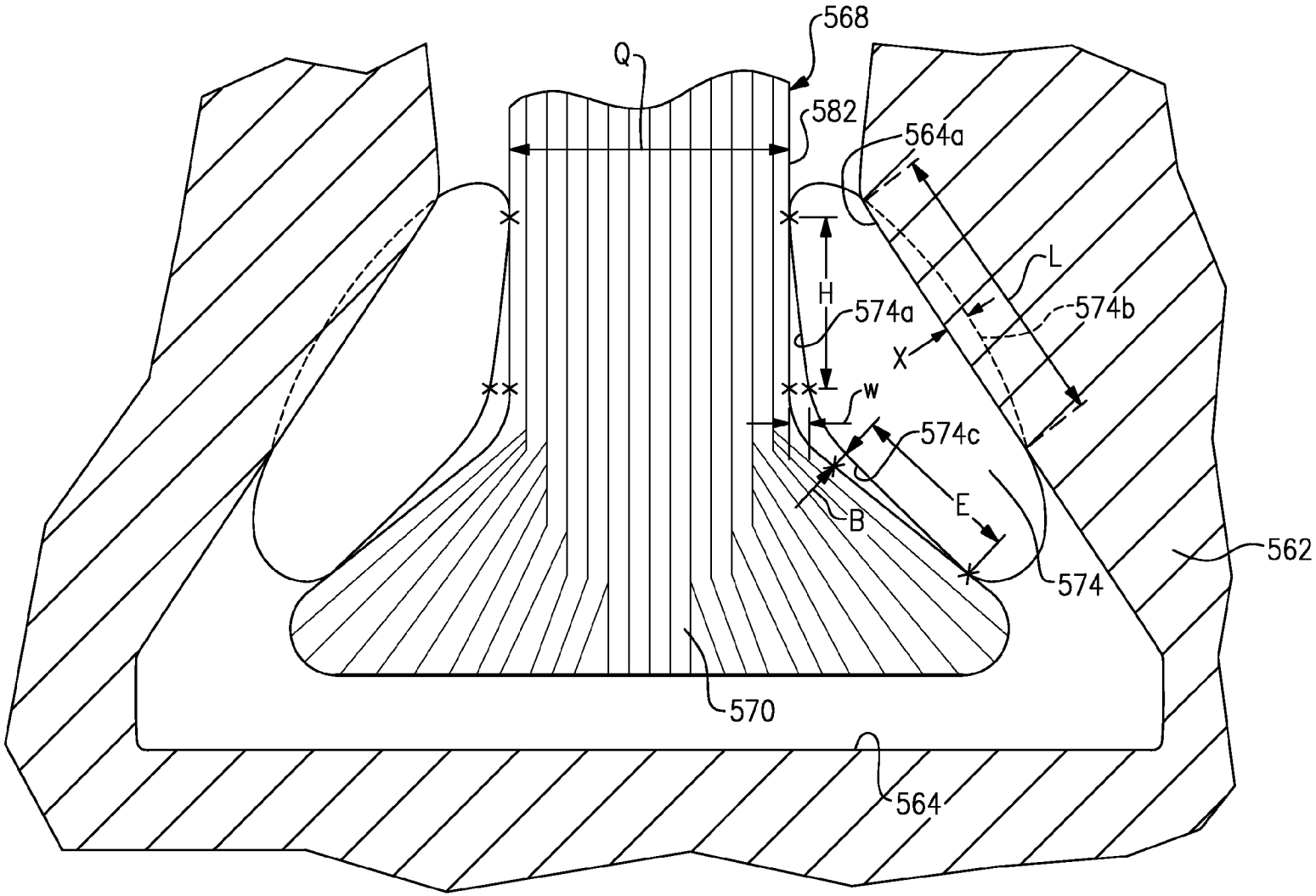

FIG. 8 shows another modified wedge 574 that has a first side 574*a*, a second side 574*b* and a third side 574*c*. Relative to the wedge of FIG. 3B, for example, the wedge 574 has a steeper angle between the first side 574*a* and the third side 574*c*, which controls interface points of the first side 574*a* and the third side 574*c* and thus the distribution of pressure.

The first side 574*a* thus contacts the neck 582 a point contact and the third side 574*c* contacts the flared root 570 at a point contact.

In this example, the wedge 574 has a specific geometry defined by dimensions that are shown in FIG. 8. Moreover, as will be described, the geometric dimensions are not independent of each other and are interrelated through numerous ratio-based relationships. As shown in the drawing, the geometric dimensions are as follows:

Q is the width of the neck 582 along a direction perpendicular to the engine central axis A, L is a length dimension of the second side 574*b* in contact with the circumferential side 564*a* of the disk 562, E is a length dimension of a straight portion of the third side 574*c*, H is a length dimension of a straight portion of the first side 574*a*, X is an overlap distance between the circumferential side 564*a* of the disk 562 and the second side 574*b*, B is a gap dimension between the flared root 570 and the third side 574*c* at a point of transition between a straight portion of the third side 574*c* and a curved portion of the wedge 574, and W is a gap dimension between the neck 582 and the first side 574*a* at a point of transition between a straight portion of the first side 574*a* and a curved portion of the wedge 574.

The geometric dimensions are interrelated through one or more of the following ratio-based relationships:

W/Q (W divided by Q) is less than or equal to 0.025,

W/H is less than or equal to 0.1,

X/L is less than or equal to 0.050, and

B/E is less than or equal to 0.080.

Figure 9:
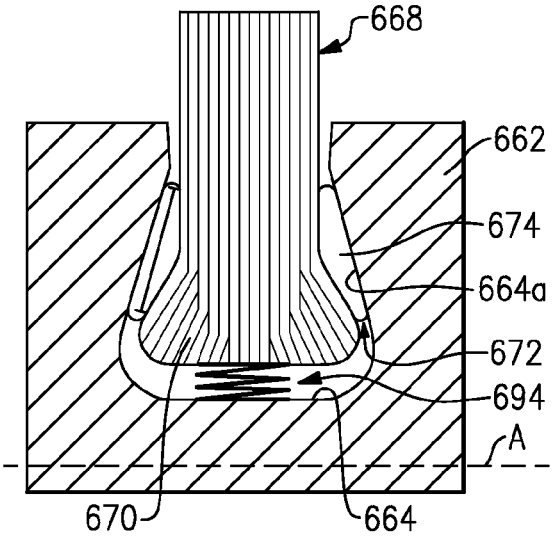

FIG. 9 illustrates another example that is similar to the example shown in FIG. 3B but includes a bias member 694 within the axial slot 664. For example, the bias member 694 is a sheet or spring metal spring. The bias member 694 is located radially inwardly of the blade 668 adjacent the flared root 670. Thus, the bias member 694 is located between a radially inner surface of the axial slot 664 and the bottom of the blade 668. The bias member 694 biases the blade 668 radially outwardly relative to the engine central axis A (shown schematically). The biasing of the blade 668 radially outwardly captures the wedges 674 within the circumferential gaps 672 between the blade 668 and the circumferential sides 664*a* of the axial slot 664 to limit movement of the wedges 674 within the circumferential gaps 672.

Figure 10A:
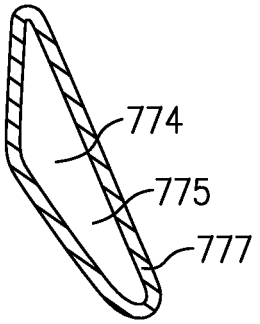
FIG. 10A shows a wedge that has a coating.

FIG. 10A illustrates another modified wedge 774, which may have the shape of any of the wedges disclosed herein. In this example, the wedge 774 includes a core 775 and a coating 777 that extends around the core 775. Thus, the coating 777 interfaces with the blade and the circumferential side of the axial slot of any of the prior examples. The coating 777 is designed to enhance the function of the wedge 774. For instance, the coating 777 may be lubricious to reduce friction, hard to reduce wear and/or have chemical properties to enhance durability in particular environmental conditions. For example, the core 775 includes a ceramic material, a metallic material or combination thereof and the coating 777 is selected from silicon metal, gold, ceramic, metal alloy or composite materials that include reinforcement elements dispersed within a matrix material.

Figure 10B:
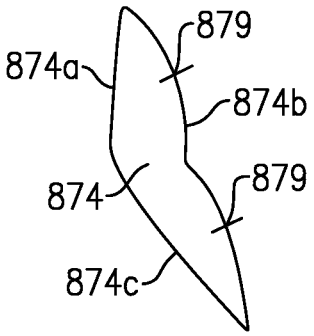
FIG. 10B shows a wedge that has multiple crowns.

FIG. 10B illustrates another modified wedge 874 that has a first side 874*a*, a second side 874*b* and a third side 874*c*. In this example, the second side 874*b* has multiple crowns 879, which for purposes of description are exaggerated in size. The crowns 879 provide two lines of contact. It is to be understood that any of the prior described crowned sides may be modified to include multiple crowns to provide multiple lines of contact at their respective interfaces.

Figure 11:
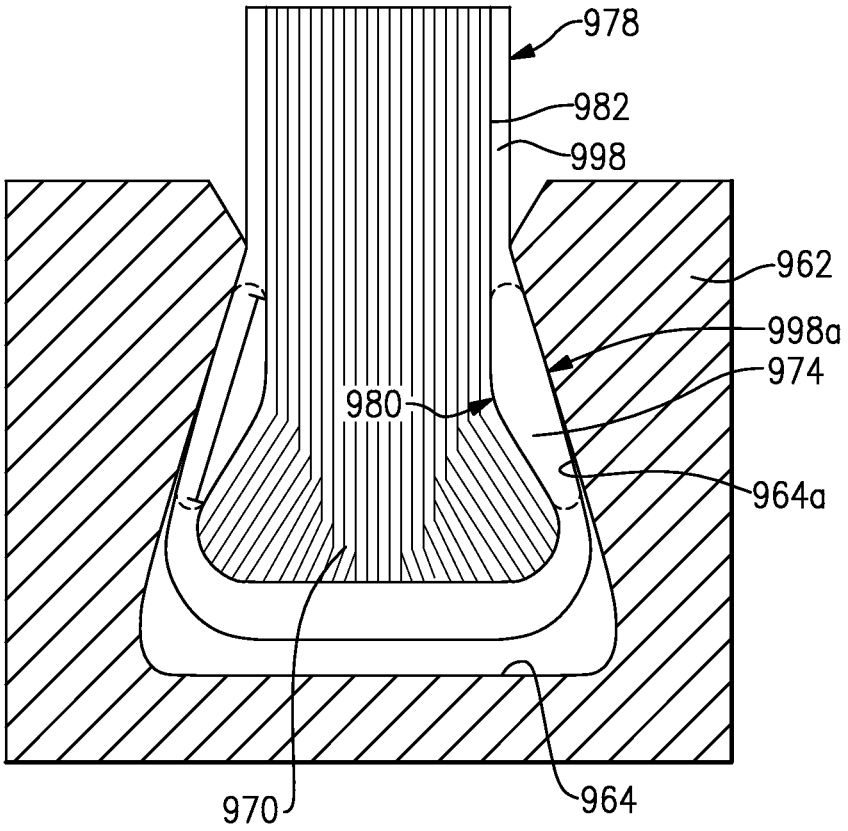
FIG. 11 shows another example rotor that has a blade with a coating that functions as a wedge.

FIG. 11 illustrates another example of a blade 978 mounted within an axial slot 964. In this example, instead of a free floating wedge, the blade has a coating 998 that is shaped to function as a wedge. The coating 998 extends over at least a portion of the neck 982, the narrow fillet 980 and at least a portion of the flared root 970. The coating 998 includes a relatively thick section 998*a* on each circumferential side of the narrow fillet 980. The relatively thick portion 998*a* is operable as a wedge 974 (shown in dashed lines) to compress the narrow fillet 980 upon loading of the blade 978 when the disk 962 rotates.

In a further example, the coating 998 includes a silicon-containing material. For example, the coating 998 is silicon metal or silicon carbide. In other examples, the coating 998 includes an environmental coating that also protects the underlying blade material. The coating 998 can be deposited using a known coating technique, such as spray-coating. In one example, the coating 998 is initially applied in a greater thickness than desired and then machined to the desired geometry.

Figure 12A:
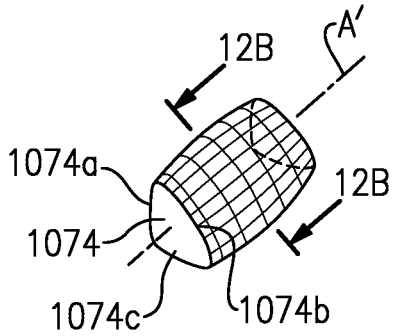
FIG. 12A shows an isolated view of another example wedge having convex sides.
Figure 12B:
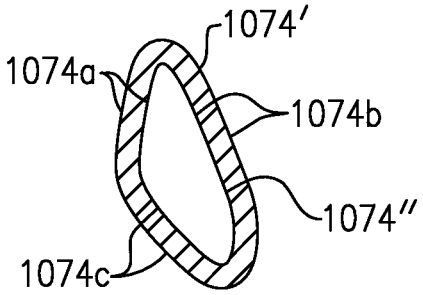
FIG. 12B shows overlaid cross-sections of the wedge of FIG. 12A.
Figure 12C:
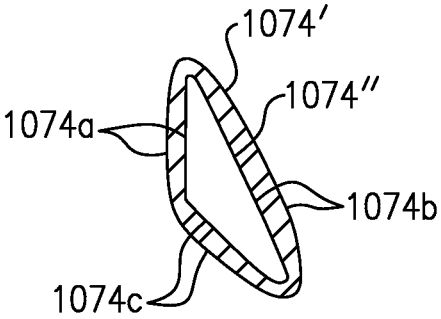
FIG. 12C shows overlaid cross-sections of a modified wedge.

FIG. 12A illustrates another modified wedge 1074 where the sides 1074*a-c* are crowned with respect to axis A', which is parallel to the engine central axis A. In this example, each of the sides 1074*a-c* is convex over the entire axial length of the wedge 1074. FIG. 12B shows the convex shape as represented by a cross-section 1074' taken mid-way between the terminal ends of the wedge 1074 superimposed on a cross-section 1074" taken at the forward terminal end of the wedge 1074. That is, the sides 1074*a-c* are convex at both cross-sections 1074' and 1074". FIG. 12C shows a modified version where the convex curvature straightens at the terminal ends.

Figure 13A:
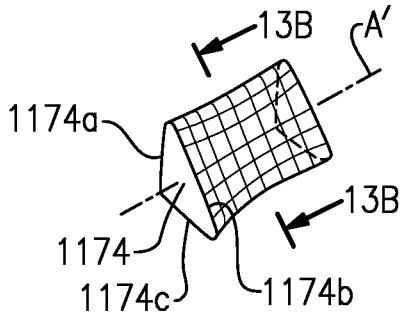
FIG. 13A shows an isolated view of another example wedge having concave sides.
Figure 13B:
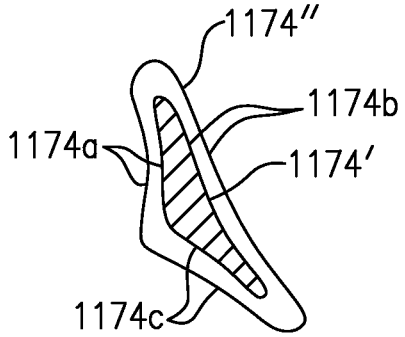
FIG. 13B shows overlaid cross-sections of the wedge of FIG. 13A.
Figure 13C:
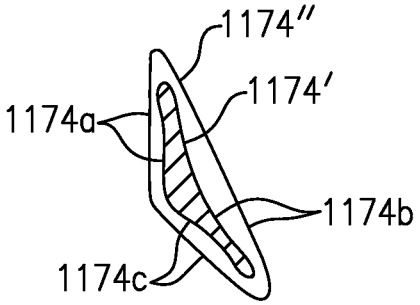
FIG. 13C shows overlaid cross-sections of a modified wedge.

FIG. 13A illustrates another modified wedge 1174 where the sides 1174*a-c* are crowned with respect to axis A', which is parallel to the engine central axis A. In this example, each of the sides 1174*a-c* is concave over the entire axial length of the wedge 1174. FIG. 13B shows the concave shape as represented by a cross-section 1174' taken mid-way between the terminal ends of the wedge 1174 superimposed on a cross-section 1174" taken at the forward terminal end of the wedge 1174. That is, the sides 1174*a-c* are concave at both cross-sections 1174' and 1174". FIG. 13C shows a modified version where the concave curvature straightens at the terminal ends.

The convex wedge 1074 and the concave wedge 1174 each provide a non-uniform level of compressive stress as a function of axial location on a blade at the neck and flared root. For example, a wedge that is shaped to apply a uniform compressive stress as a function of axial location may actually tend to be more effective at mitigating tensile stress in the axial middle of the neck and flared root due to the relative stiffness and deflection inherent in the blade, wedge and disk and/or due to rotational and friction effects. However, the convex wedge 1074 and the concave wedge 1174 have geometries that provide a non-uniform level of compressive stress as a function of axial location and can thus reduce the axial variation in mitigation of tensile stress by concentrating the compressive stress at particular locations such that the mitigation effect is more uniform as a function of axial location.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A rotor comprising:

a disk including slots circumferentially arranged around its periphery;

blades including respective roots that are mounted in respective ones of the slots, the roots being smaller than the slots such that there are circumferential gaps between the roots and circumferential sides of the slots; and wedges respectively located in the circumferential gaps, the wedges being free floating with regard to the blades and the disk and the wedges each having a tapered thickness profile in the respective circumferential gap, with the wedges in contact with either the roots or circumferential sides of the slots at respective contact interfaces, each of the contact interfaces including a curved surface in contact with a flat surface such that there is a point or line of contact between the curved surface and the flat surface.

2. The rotor as recited in claim 1, wherein each of the wedges includes less than three flat sides.

3. The rotor as recited in claim 1, wherein each of the blades includes a ceramic material.

4. The rotor as recited in claim 3, wherein the ceramic material is a multi-layer fiber structure including a ceramic matrix.

5. The rotor as recited in claim 1, wherein each of the wedges includes at least one crowned side.

6. The rotor as recited in claim 1, wherein each of the wedges includes a plurality of crowned sides.

7. The rotor as recited in claim 1, wherein each of the wedges includes sides that are in contact with either the blades or the circumferential sides of the slots, each of the sides being either a flat side or a crowned side such that there is a number $N_1$ of flat sides and a number $N_2$ of crowned sides, and a ratio of $N_1/N_2$ is 2 or less.

8. The rotor as recited in claim 7, wherein $N_1$ is 2 and $N_2$ is 1.

9. The rotor as recited in claim 7, wherein $N_1$ is 0 and $N_2$ is 2.

10. The rotor as recited in claim 7, wherein $N_1$ is 2 and $N_2$ is 3.

11. The rotor as recited in claim 7, wherein $N_1$ is 1 and $N_2$ is 2.

12. The rotor as recited in claim 7, wherein $N_1$ is 1 and $N_2$ is 1.

13. The rotor as recited in claim 1, wherein each of the wedges includes a coating thereon that surrounds a core.

14. The rotor as recited in claim 1, including bias members located in respective ones of the slots radially inwardly of the blades, the bias members biasing the blades radially outwardly.

15. The rotor as recited in claim 1, wherein the curved surface is on the wedge.

16. The rotor as recited in claim 15, wherein the roots are flared roots.

17. The rotor as recited in claim 15, wherein blades include respective airfoils and necks connecting the airfoils with the roots, and the wedges each include another curved surface in another contact interface with the necks.

18. The rotor as recited in claim 1, wherein the wedges each include a radially intermediate portion between radially inner and outer ends, and the tapered thickness profile tapers from the radially intermediate portion to each of the radially inner and outer ends.

19. The rotor comprising:

a disk including slots circumferentially arranged around it periphery;

blades including respective roots that are mounted in respective ones of the slots, the roots being smaller than the slots such that there are circumferential gaps between the roots and circumferential sides of the slots; and wedges respectively located in the circumferential gaps, the wedges being free floating with regard to the blades and the disk, with a width dimension (Q) of a neck of the respective blades, a length dimension (L) of a side of the respective wedges in contact with the circumferential side of the disk, a length dimension (E) of a straight portion of another side of the respective wedges, a length dimension (H) of a straight portion of another, different side of the respective wedges, and overlap dimension (X) between the circumferential side of the disk and the side of the respective wedges that has length dimension (L), a gap dimension (B) between a flared root of the respective blades and the side of the respective wedges that has length dimension (E) at a point of transition between a straight portion and a curved portion, and a gap dimension (W) between the neck and the side of the respective wedges that has length dimension (H) at a point of transition between a straight portion and a curved portion, and including at least one of:

W/Q is less than or equal to 0.025,

W/H is less than or equal to 0.1,

X/L is less than or equal to 0.050, and

B/E is less than or equal to 0.080.

20. The rotor as recited in claim 19, wherein each of the wedges included less than three flat sides.

21. The rotor as recited in claim 19, wherein each of the blades includes a ceramic material.

22. The rotor as recited in claim 19, wherein each of the wedges includes a coating therein that surrounds a core.

23. The rotor as recited in claim 19, including bias members located in respective ones of the slots radially inwardly of the blades, the bias members biasing the blades radially outwardly.

24. A gas turbine engine, comprising:

optionally, a fan a compressor section;

a combustor in fluid communication with the compressor section; and a turbine section in fluid communication with the combustor, the turbine section being coupled to drive the compressor section and the fan, at least one of the fan, the turbine section and the compressor section including a disk having slots circumferentially arranged around its periphery, blades including respective roots that are mounted in respective ones of the slots, the roots being smaller than the slots such that there are circumferential gaps between the roots and circumferential sides of the slots, and wedges respectively located within the circumferential gaps, the wedges being free floating with regard to the blades and the disk, with the wedges in contact with either the roots or circumferential sides of the slots at respective contact interfaces, each of the contact interfaces including a curved surface in contact with a flat surface such that there is appoint or line of contact between the curved surface and the flat surface, with a width dimension (Q) of a neck of the respective blades, a length dimension (L) of a side of the respective wedges in contact with the circumferential side of the disk, a length dimension (E) of a straight portion of another side of the respective wedges, a length dimension (H) of a straight portion of another, different side of the respective wedges, and overlap dimension (X) between the circumferential side of the disk and the side of the respective wedges that has length dimension (L), a gap dimension (B) between a flared root of the respective blades and the side of the respective wedges that has length dimension (E) at a point of transition between a straight portion and curved portion, and a gap dimension (W) between the neck and the side of the respective wedges that has length dimension (H) at a point of transition between a straight portion and a curved portion, and including at least one of:

W/Q is less than or equal to 0.025,

W/H is less than or equal to 0.1,

X/L is less than or equal to 0.050, and

B/E is less than or equal to 0.080.

* * * * *